US010941966B2

(12) United States Patent
Sishtla et al.

(10) Patent No.: US 10,941,966 B2
(45) Date of Patent: Mar. 9, 2021

(54) HOT GAS BYPASS ENERGY RECOVERY

(71) Applicant: Carrier Corporation, Palm Beach Gardens, FL (US)

(72) Inventors: Vishnu M. Sishtla, Manlius, NY (US); William T. Cousins, Glastonbury, CT (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 95 days.

(21) Appl. No.: 16/268,977

(22) Filed: Feb. 6, 2019

(65) Prior Publication Data

US 2019/0242631 A1 Aug. 8, 2019

Related U.S. Application Data

(60) Provisional application No. 62/626,874, filed on Feb. 6, 2018.

(51) Int. Cl.
*F25B 41/04* (2006.01)
*F25B 41/00* (2021.01)

(52) U.S. Cl.
CPC ..... *F25B 41/043* (2013.01); *F25B 41/00* (2013.01); *F25B 2341/0012* (2013.01);
(Continued)

(58) Field of Classification Search
CPC ..... F25B 41/043; F25B 41/00; F25B 2341/0012; F25B 2341/0014;
(Continued)

(56) References Cited

U.S. PATENT DOCUMENTS 4,248,055 A 2/1981 Day et al.
5,481,887 A * 1/1996 Terasaki ..... F04D 29/063 62/471
(Continued)

FOREIGN PATENT DOCUMENTS

CN 102128508 A 7/2011
CN 102374694 A 3/2012
(Continued)

OTHER PUBLICATIONS

European Search Report for application EP 19155533.3, dated Jul. 11, 2019, 7 pages.

*Primary Examiner* — Frantz F Jules
*Assistant Examiner* — Martha Tadesse
(74) *Attorney, Agent, or Firm* — Cantor Colburn LLP

(57) ABSTRACT

System includes a compressor having a compressor suction port and a compressor discharge port; a heat rejection heat exchanger fluidly coupled to the compressor discharge port; an expansion device fluidly coupled to an outlet of the heat rejection heat exchanger; a heat absorption heat exchanger fluidly coupled to the expansion device; a hot gas bypass line fluidly coupled to the compressor discharge port; an ejector comprising a motive port fluidly coupled to the hot gas bypass line, a suction port fluidly coupled to an outlet of the heat absorption heat exchanger and a discharge port fluidly coupled to the compressor suction port; a hot gas bypass valve positioned between the compressor discharge port and the motive port of the ejector; a flow control valve fluidly coupled to the outlet of the heat absorption heat exchanger, and fluidly coupled to the suction port of the ejector and the compressor suction port.

11 Claims, 2 Drawing Sheets

(52) U.S. Cl.
CPC ..... *F25B 2341/0014* (2013.01); *F25B 2600/2501* (2013.01); *F25B 2600/2507* (2013.01)

(58) Field of Classification Search
CPC ..... F25B 2600/2507; F25B 2600/2501; F25B 2600/2515; F25B 41/062; B60H 2001/3298; Y02B 30/52
See application file for complete search history.

(56) References Cited

U.S. PATENT DOCUMENTS

| | | | | |
|---|---|---|---|---|
| 6,427,464 | B1 | 8/2002 | Beaverson et al. | |
| 6,574,987 | B2 | 6/2003 | Takeuchi et al. | |
| 6,584,794 | B2 | 7/2003 | Takeuchi et al. | |
| 6,698,221 | B1 * | 3/2004 | You | F25B 41/00 62/196.4 |
| 6,729,149 | B2 | 5/2004 | Takeuchi | |
| 6,729,158 | B2 | 5/2004 | Sakai et al. | |
| 6,779,360 | B2 | 8/2004 | Kawamura et al. | |
| 6,782,713 | B2 | 8/2004 | Takeuchi | |
| 6,966,199 | B2 | 11/2005 | Takeuchi | |
| 7,347,062 | B2 | 3/2008 | Nishijima et al. | |
| 7,520,142 | B2 | 4/2009 | Saito et al. | |
| 7,757,514 | B2 | 7/2010 | Oshitani et al. | |
| 7,779,647 | B2 | 8/2010 | Takeuchi et al. | |
| 8,640,491 | B2 | 2/2014 | Shoulders | |
| 8,713,962 | B2 | 5/2014 | Okazaki | |
| 8,931,288 | B2 | 1/2015 | Qu | |
| 9,217,590 | B2 | 12/2015 | Cogswell et al. | |
| 9,759,462 | B2 | 9/2017 | Zou et al. | |
| 10,131,203 | B2 * | 11/2018 | Suzuki | F25B 41/04 |
| 10,500,925 | B2 * | 12/2019 | Oshitani | B60H 1/00814 |
| 2013/0186128 | A1 * | 7/2013 | Kim | F25B 31/004 62/470 |
| 2016/0280041 | A1 * | 9/2016 | Suzuki | F25B 41/04 |
| 2017/0167767 | A1 | 6/2017 | Shi et al. | |
| 2017/0356683 | A1 | 12/2017 | Park et al. | |

FOREIGN PATENT DOCUMENTS

| | | | | | |
|---|---|---|---|---|---|
| CN | 103954061 | A | | 7/2014 | |
| CN | 104457008 | A | | 3/2015 | |
| CN | 105402959 | A | | 3/2016 | |
| CN | 105928201 | A | | 9/2016 | |
| EP | 3225939 | A | | 10/2017 | |
| JP | 6096551 | B | * | 11/1994 | |
| JP | 10197077 | A | * | 7/1998 | |
| JP | 2012117760 | A | | 6/2012 | |
| JP | 2012117760 | A | * | 6/2012 | |
| JP | 2014190578 | A | * | 10/2014 | |
| JP | 2014190579 | A | * | 10/2014 | |
| JP | 2015108466 | A | | 6/2015 | |
| JP | 6069179 | B2 | * | 2/2017 | |
| JP | 6275283 | B2 | * | 2/2018 | F25B 41/067 |
| KR | 100876285 | B1 | * | 12/2008 | |
| KR | 20110100905 | A | * | 9/2011 | F25B 43/02 |
| WO | 2015052881 | A1 | | 4/2015 | |

* cited by examiner

HOT GAS BYPASS ENERGY RECOVERY

CROSS-REFERENCE TO RELATED APPLICATIONS

This application claims the benefit of U.S. provisional patent application Ser. No. 62/626,874, filed Feb. 6, 2018, the entire contents of which are incorporated herein by reference.

BACKGROUND

Embodiments relate generally to refrigerant vapor compression systems used in air conditioning systems, and more particularly to a system for recovering energy from a hot gas bypass line in a refrigerant vapor compression system.

Existing refrigerant vapor compression systems may employ a centrifugal compressor. Capacity control of a centrifugal compressor may be achieved using inlet guide vanes. In some installations, however, the sizing of the compressor inlet prohibits the ability to use inlet guide vanes to control capacity. Hot gas bypass is another technique used to control capacity, but hot gas bypass is not energy efficient.

SUMMARY

In one embodiment, a refrigerant vapor compression system includes a compressor having a compressor suction port and a compressor discharge port; a heat rejection heat exchanger fluidly coupled to the compressor discharge port; an expansion device fluidly coupled to an outlet of the heat rejection heat exchanger; a heat absorption heat exchanger fluidly coupled to the expansion device; a hot gas bypass line fluidly coupled to the compressor discharge port; an ejector comprising a motive port fluidly coupled to the hot gas bypass line, a suction port fluidly coupled to an outlet of the heat absorption heat exchanger and a discharge port fluidly coupled to the compressor suction port; a hot gas bypass valve positioned between the compressor discharge port and the motive port of the ejector; a flow control valve fluidly coupled to the outlet of the heat absorption heat exchanger, and fluidly coupled to the suction port of the ejector and the compressor suction port.

Additionally or alternatively, in this or other embodiments, a controller is configured to control the hot gas bypass valve and the flow control valve.

Additionally or alternatively, in this or other embodiments, the controller is configured to open the hot gas bypass valve and set the flow control valve to fluidly couple the outlet of the heat absorption heat exchanger with the suction port of the ejector.

Additionally or alternatively, in this or other embodiments, the controller is configured to open the hot gas bypass valve when a temperature of a fluid exiting the heat absorption heat exchanger is less than a setpoint.

Additionally or alternatively, in this or other embodiments, the controller is configured to open the hot gas bypass valve when a temperature of a fluid exiting the heat absorption heat exchanger is less than a setpoint and one of (i) a ratio of pressure at the heat rejection heat exchanger to pressure at the heat absorption heat exchanger is greater than a limit or (ii) pressure pulsations are present at the compressor discharge port.

Additionally or alternatively, in this or other embodiments, the controller is configured to open the hot gas bypass valve when a ratio of pressure at the heat rejection heat exchanger to pressure at the heat absorption heat exchanger is greater than a limit.

Additionally or alternatively, in this or other embodiments, the controller is configured to close the hot gas bypass valve and set the flow control valve to fluidly couple the outlet of the heat absorption heat exchanger with the compressor suction port.

Additionally or alternatively, in this or other embodiments, wherein the controller is configured to close the hot gas bypass valve when a temperature of a fluid exiting the heat absorption heat exchanger is greater than a setpoint.

Additionally or alternatively, in this or other embodiments, the controller is configured to close the hot gas bypass valve when a temperature of a fluid exiting the heat absorption heat exchanger is greater than a setpoint and one of (i) a ratio of pressure at the heat rejection heat exchanger to pressure at the heat absorption heat exchanger is less than a limit or (ii) pressure pulsations are not present at the compressor discharge port.

Additionally or alternatively, in this or other embodiments, the compressor is a centrifugal compressor.

In another embodiment, a method of controlling a refrigerant vapor compression system including a compressor having a compressor suction port and a compressor discharge port, a heat rejection heat exchanger, a hot gas bypass line fluidly coupled to the compressor discharge port, an ejector comprising a motive port fluidly coupled to the hot gas bypass line, a suction port fluidly coupled to an outlet of the heat absorption heat exchanger and a discharge port fluidly coupled to the compressor suction port, a hot gas bypass valve positioned between the compressor discharge port and the compressor suction port and a flow control valve fluidly coupled to an outlet of a heat absorption heat exchanger, and fluidly coupled to the suction port of the ejector and the compressor suction port, the method including: opening the hot gas bypass valve and setting the flow control valve to fluidly couple the outlet of the heat absorption heat exchanger with the suction port of the ejector.

Additionally or alternatively, in this or other embodiments, the method includes opening the hot gas bypass valve when a temperature of a fluid exiting the heat absorption heat exchanger is less than a setpoint.

Additionally or alternatively, in this or other embodiments, the method includes opening the hot gas bypass valve when a temperature of a fluid exiting the heat absorption heat exchanger is less than a setpoint and one of (i) a ratio of pressure at the heat rejection heat exchanger to pressure at the heat absorption heat exchanger is greater than a limit or (ii) pressure pulsations are present at the discharge port of the compressor.

Additionally or alternatively, in this or other embodiments, the method includes opening the hot gas bypass valve when a ratio of pressure at the heat rejection heat exchanger to pressure at the heat absorption heat exchanger is greater than a limit.

Additionally or alternatively, in this or other embodiments, the method includes closing the hot gas bypass valve and setting the flow control valve to fluidly couple the outlet of the heat absorption heat exchanger with the suction port of the compressor.

Additionally or alternatively, in this or other embodiments, the method includes closing the hot gas bypass valve when a temperature of a fluid exiting the heat absorption heat exchanger is greater than a setpoint.

Additionally or alternatively, in this or other embodiments, the method includes closing the hot gas bypass valve when a temperature of a fluid exiting the heat absorption heat exchanger is greater than a setpoint and one of (i) a ratio of pressure at the heat rejection heat exchanger to pressure at the heat absorption heat exchanger is less than a limit or (ii) pressure pulsations are not present at the discharge port of the compressor.

Technical effects include the ability recover energy from a hot gas bypass operation through the use of an ejector in the hot gas bypass line.

These and other advantages and features will become more apparent from the following description taken in conjunction with the drawings.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

The detailed description explains embodiments, together with advantages and features, by way of example with reference to the drawings.

DETAILED DESCRIPTION

Figure 1:
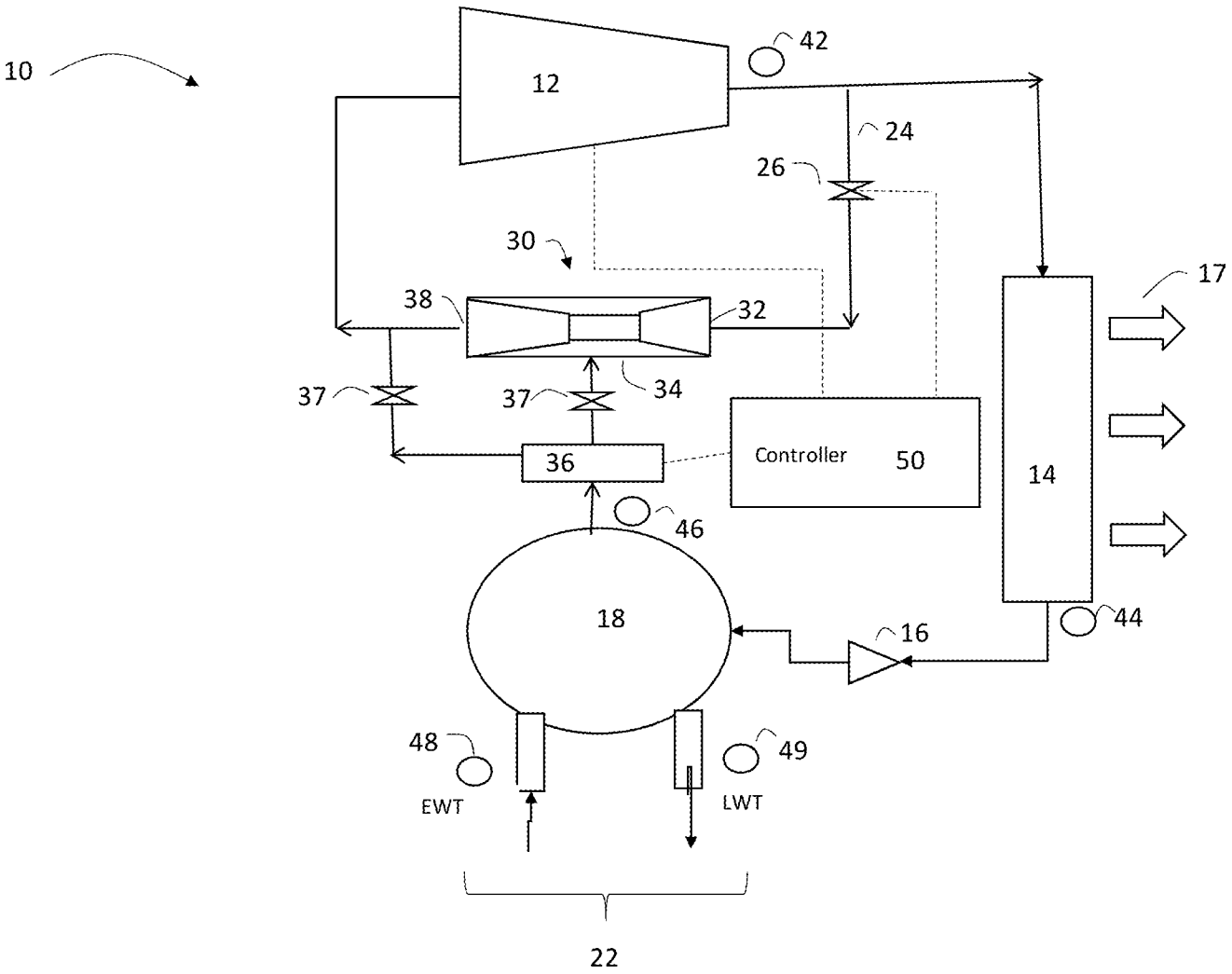
FIG. 1 depicts a refrigerant vapor compression system in an example embodiment.

FIG. 1 illustrates a refrigerant vapor compression system 10 in an example embodiment. The refrigerant vapor compression system 10 may be a chiller, a rooftop unit, or other type of system. In the refrigerant vapor compression system 10, refrigerant flows in a closed loop from a compressor 12, to a heat rejection heat exchanger 14, to an expansion device 16 (e.g., an expansion valve), to a heat absorption heat exchanger 18 and then back to the compressor 12 in a fluidly coupled loop. The compressor 12 may be a variable speed compressor, having a speed controlled by a controller 50. The compressor 12 may be a centrifugal compressor in an example embodiment. In the heat rejection heat exchanger 14, the refrigerant is cooled by transferring heat to a fluid 17 flowing in heat exchange relationship with the refrigerant (e.g., air). In the heat absorption heat exchanger 18, the refrigerant is heated by transferring heating from a fluid flowing in heat exchange relationship with the refrigerant (e.g., air or liquid). In the example in FIG. 1, liquid (e.g., water) from a loop, generally designated at 22, flows in heat exchange relationship to the refrigerant and is cooled by transferring heat to the refrigerant.

A hot gas bypass line 24 is fluidly coupled to the discharge port of the compressor 12. The hot gas bypass line 24 is fluidly coupled to a motive port 32 of an ejector 30 through a hot gas bypass valve 26. A suction port 34 of the ejector 30 is fluidly coupled to the outlet of the heat absorption heat exchanger 18 through a flow control valve 36. A discharge port 38 of the ejector 30 is fluidly coupled to the suction port of the compressor 12. The outlet of the heat absorption heat exchanger 18 is also connected to the suction port of the compressor 12 through the flow control valve 36. Flow control valve 36 can direct the refrigerant leaving the heat absorption heat exchanger 18 to one of the suction port 34 of the ejector 30 and the suction port of the compressor 12. In other embodiments, the flow control vale 36 may divert a first portion of the refrigerant leaving the heat absorption heat exchanger 18 to the suction port 34 of the ejector 30 and a second portion of the refrigerant leaving the heat absorption heat exchanger 18 to the suction port of the compressor 12. Check valves 37 prevent flow of refrigerant back into the heat absorption heat exchanger 18.

A number of sensors monitor operating parameters of the refrigerant vapor compression system 10. Sensor 42 monitors discharge pressure of the compressor 12 and may be used to detect discharge pressure pulsations, as described in further detail herein. Sensor 44 monitors pressure of the heat rejection heat exchanger 14. Sensor 46 monitors pressure of the heat absorption heat exchanger 18. Sensors 48 and 49 monitor temperature of fluid entering the heat absorption heat exchanger 18 (e.g., entering water temperature EWT) and temperature of fluid exiting the heat absorption heat exchanger 18 (e.g., leaving water temperature LWT). It is understood that other sensors may be used in the control of the refrigerant vapor compression system 10, which are not depicted in FIG. 1.

A controller 50 receives sensed operating parameters from the various sensors and controls operation of one or more of the speed of the compressor 12, the opening of the hot gas bypass valve 26 and the flow of refrigerant through the flow control valve 36 by providing control signals to the compressor 12, the hot gas bypass valve 26 and the flow control valve 36. The controller 50 can be any type or combination of processors, such as a microprocessor, microcontroller, digital signal processor, application specific integrated circuit, programmable logic device, and/or field programmable gate array. The hot gas bypass valve 26 and the flow control valve 36 may operate in unison. For example, when the hot gas bypass valve 26 is closed, the flow control valve 36 is configured to fluidly couple the outlet of the heat absorption heat exchanger 18 with the suction port of the compressor 12, avoiding the ejector 30. If the hot gas bypass valve 26 is opened, the flow control valve 36 is configured to fluidly couple the outlet of the heat absorption heat exchanger 18 with the suction port 34 of the ejector 30.

The ejector 30 is used to lower energy usage of the compressor 12 when the hot gas bypass valve 26 is open. The flow of refrigerant from the discharge port of the compressor 12 through the ejector 30 causes refrigerant to be drawn from the heat absorption heat exchanger 18, increasing the compressor suction pressure thereby reducing work needed by the compressor 12.

Figure 2:
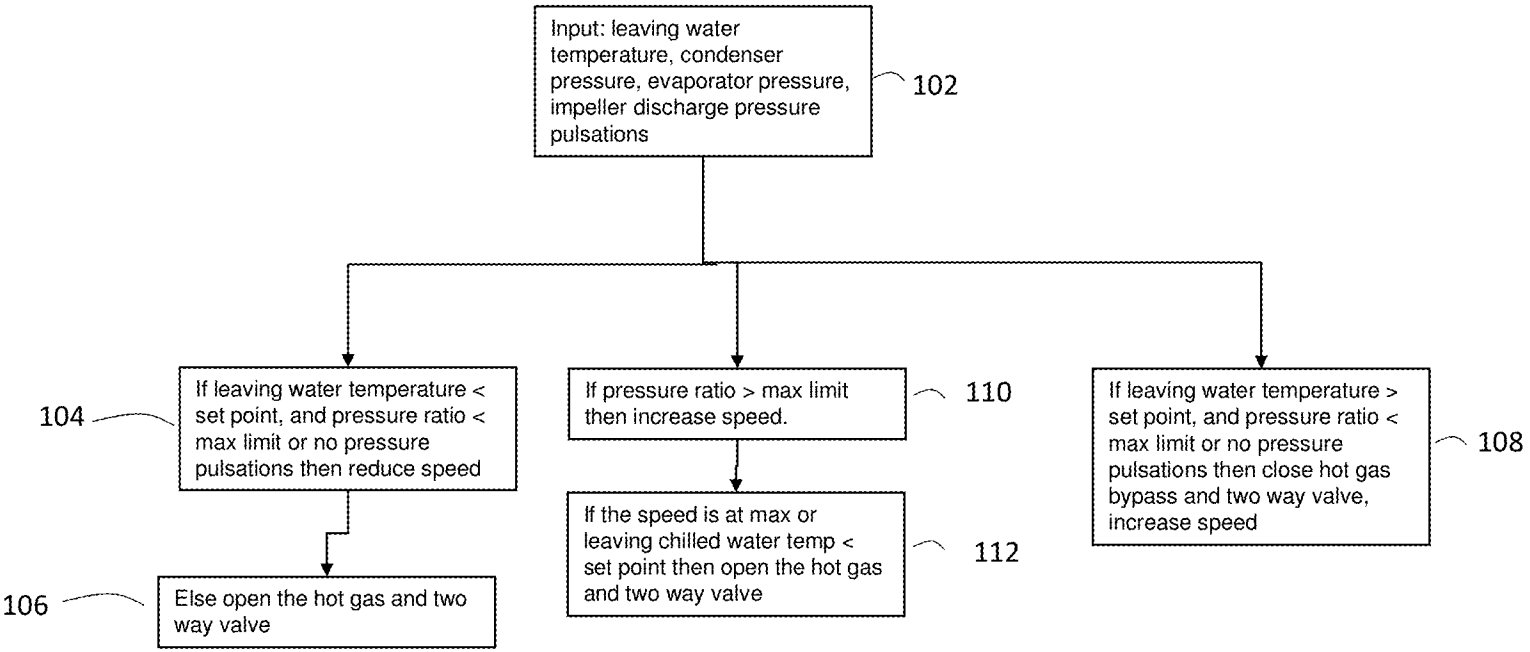
FIG. 2 depicts operating points for the refrigerant vapor compression system.

FIG. 2 depicts three operating modes for the refrigerant vapor compression system 10. As shown at 102, the controller 50 receives various inputs including the temperature of fluid exiting the heat absorption heat exchanger 18 (e.g., leaving water temperature), pressure at the heat rejection heat exchanger 14 (e.g., condenser pressure), pressure at the heat absorption heat exchanger 18 (e.g., evaporator pressure) and the presence of discharge pressure pulsations at the discharge port of the compressor 12.

At the operating point shown at 104, the leaving water temperature is less than a setpoint. This means that the capacity of compressor 12 may be reduced since the setpoint is met. At 104, if the leaving water temperature is less than a set point, and a pressure ratio is less than a limit or no pressure pulsations are detected at the discharge port of the compressor 12, then the controller 50 reduces the speed of the compressor 12. The pressure ratio is the ratio of pressure in the heat rejection heat exchanger 14 to pressure in the heat absorption heat exchanger 18. If, however, either the pressure ratio is greater than a limit or pressure pulsations are detected at the discharge port of the compressor 12, then the controller opens the hot gas bypass valve 26 as shown at 106. Opening the hot gas bypass valve 26 initiates a corresponding change in flow control valve 36. For example, if the hot gas bypass valve 26 is opened, then the flow control valve 36 is adjusted to direct refrigerant leaving the heat absorption heat exchanger 18 to the suction port 34 of the ejector 30.

At the operating point shown at 108, the leaving water temperature is greater than a setpoint. This means that the capacity of compressor 12 may be increased since the setpoint is not met. At 108, if the leaving water temperature is greater than a set point, and a pressure ratio is less than a limit or no pressure pulsations are detected at the discharge port of the compressor 12, then the controller closes the hot gas bypass vale 26 (if opened) and increases speed of the compressor 12. The pressure ratio is the ratio of pressure in the heat rejection heat exchanger 14 to pressure in the heat absorption heat exchanger 18. Closing the hot gas bypass valve 26 initiates a corresponding change in the flow control valve 36 so that no refrigerant leaving the heat absorption heat exchanger 18 is directed to the suction port 34 of the ejector 30.

At the operating point shown at 110, the pressure ratio is compared to a pressure ratio limit. The pressure ratio is the ratio of pressure in the heat rejection heat exchanger 14 to pressure in the heat absorption heat exchanger 18. If at 110, the pressure ratio is greater than a pressure ratio limit, then the speed of compressor 12 is increased. If the speed of the compressor is already at a maximum or if the leaving water temperature is less than a set point, then the controller 50 opens the hot gas bypass valve 26 and adjusts the flow control valve 36 to direct refrigerant exiting the heat absorption heat exchanger 18 to the suction port 34 of the ejector 30.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A refrigerant vapor compression system comprising:

a compressor having a compressor suction port and a compressor discharge port;

a heat rejection heat exchanger fluidly coupled to the compressor discharge port;

an expansion device fluidly coupled to an outlet of the heat rejection heat exchanger;

a heat absorption heat exchanger fluidly coupled to the expansion device;

a hot gas bypass line fluidly coupled to the compressor discharge port;

an ejector comprising a motive port fluidly coupled to the hot gas bypass line, a suction port fluidly coupled to an outlet of the heat absorption heat exchanger and a discharge port fluidly coupled to the compressor suction port;

a hot gas bypass valve positioned between the compressor discharge port and the motive port of the ejector;

a flow control valve fluidly coupled to the outlet of the heat absorption heat exchanger, and fluidly coupled to the suction port of the ejector and the compressor suction port;

a controller configured to control the hot gas bypass valve and the flow control valve, the controller configured to open the hot gas bypass valve and set the flow control valve to fluidly couple the outlet of the heat absorption heat exchanger with the suction port of the ejector when at least one of:

a temperature of a fluid exiting the heat absorption heat exchanger is less than a setpoint; and a ratio of pressure at the heat rejection heat exchanger to pressure at the heat absorption heat exchanger is greater than a limit.

2. The refrigerant vapor compression system of claim 1 wherein:

the controller is configured to open the hot gas bypass valve when a temperature of a fluid exiting the heat absorption heat exchanger is less than a setpoint and one of (i) a ratio of pressure at the heat rejection heat exchanger to pressure at the heat absorption heat exchanger is greater than a limit or (ii) pressure pulsations are present at the compressor discharge port.

3. The refrigerant vapor compression system of claim 1 wherein:

the controller is configured to close the hot gas bypass valve and set the flow control valve to fluidly couple the outlet of the heat absorption heat exchanger with the compressor suction port.

4. The refrigerant vapor compression system of claim 3 wherein:

the controller is configured to close the hot gas bypass valve when a temperature of a fluid exiting the heat absorption heat exchanger is greater than a setpoint.

5. The refrigerant vapor compression system of claim 4 wherein:

the controller is configured to close the hot gas bypass valve when a temperature of a fluid exiting the heat absorption heat exchanger is greater than a setpoint and one of (i) a ratio of pressure at the heat rejection heat exchanger to pressure at the heat absorption heat exchanger is less than a limit or (ii) pressure pulsations are not present at the compressor discharge port.

6. The refrigerant vapor compression system of claim 1 wherein:

the compressor is a centrifugal compressor.

7. A method of controlling a refrigerant vapor compression system including a compressor having a compressor suction port and a compressor discharge port, a heat rejection heat exchanger, a hot gas bypass line fluidly coupled to the compressor discharge port, an ejector comprising a motive port fluidly coupled to the hot gas bypass line, a suction port fluidly coupled to an outlet of a heat absorption heat exchanger and a discharge port fluidly coupled to the compressor suction port, a hot gas bypass valve positioned between the compressor discharge port and the compressor suction port and a flow control valve fluidly coupled to an outlet of the heat absorption heat exchanger, and fluidly coupled to the suction port of the ejector and the compressor suction port, the method comprising:

opening the hot gas bypass valve and setting the flow control valve to fluidly couple the outlet of the heat absorption heat exchanger with the suction port of the ejector when at least one of:

a temperature of a fluid exiting the heat absorption heat exchanger is less than a setpoint; and a ratio of pressure at the heat rejection heat exchanger to pressure at the heat absorption heat exchanger is greater than a limit.

8. The method of claim 7 further comprising:

opening the hot gas bypass valve when a temperature of a fluid exiting the heat absorption heat exchanger is less than a setpoint and one of (i) a ratio of pressure at the heat rejection heat exchanger to pressure at the heat absorption heat exchanger is greater than a limit or (ii) pressure pulsations are present at the discharge port of the compressor.

9. The method of claim 7 further comprising:

closing the hot gas bypass valve and setting the flow control valve to fluidly couple the outlet of the heat absorption heat exchanger with the suction port of the compressor.

10. The method of claim 9 further comprising:

closing the hot gas bypass valve when a temperature of a fluid exiting the heat absorption heat exchanger is greater than a setpoint.

11. The method of claim 10 further comprising:

closing the hot gas bypass valve when a temperature of a fluid exiting the heat absorption heat exchanger is greater than a setpoint and one of (i) a ratio of pressure at the heat rejection heat exchanger to pressure at the heat absorption heat exchanger is less than a limit or (ii) pressure pulsations are not present at the discharge port of the compressor.

* * * * *